US009666388B2

(12) United States Patent
Weaver et al.

(10) Patent No.: US 9,666,388 B2
(45) Date of Patent: May 30, 2017

(54) CONTROL PANEL FOR AN APPLIANCE

(71) Applicant: General Electric Company, Schenectady, NY (US)

(72) Inventors: Mark Aaron Weaver, Crestwood, KY (US); Jonathan Michael Cepress, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 62 days.

(21) Appl. No.: 14/849,887

(22) Filed: Sep. 10, 2015

(65) Prior Publication Data

US 2017/0076879 A1 Mar. 16, 2017

(51) Int. Cl.

*H01H 13/703* (2006.01)
*H01H 13/14* (2006.01)
*H01H 13/702* (2006.01)

(52) U.S. Cl.

CPC ..... *H01H 13/14* (2013.01); *H01H 13/702* (2013.01); *H01H 13/703* (2013.01); *H01H 2215/00* (2013.01); *H01H 2221/044* (2013.01)

(58) Field of Classification Search

CPC ..... H01H 13/14; H01H 13/52; H01H 13/705; H01H 3/12; H01H 13/702; H01H 13/785; H01H 13/703

USPC ..... 200/341, 5 A, 512, 516, 511, 514.341, 200/344, 345

See application file for complete search history.

(56) References Cited

U.S. PATENT DOCUMENTS 4,901,074 A * 2/1990 Sinn ..... F24C 7/082 200/5 A
2007/0084702 A1* 4/2007 Lin ..... H01H 13/063 200/5 A
2011/0006930 A1* 1/2011 Laurent ..... H01H 13/702 341/34
2014/0001018 A1* 1/2014 Lee ..... H01H 1/06 200/275
2014/0098042 A1 4/2014 Kuo et al.
2014/0138231 A1* 5/2014 Chen ..... H01H 13/7065 200/5 A

FOREIGN PATENT DOCUMENTS

CN 2854787 Y 1/2007

* cited by examiner

*Primary Examiner* — Edwin A. Leon
*Assistant Examiner* — Ahmed Saeed
(74) *Attorney, Agent, or Firm* — Dority & Manning, P.A.

(57) ABSTRACT

A control panel for an appliance includes a tactile switch positioned on a PCB. An elastic spacer sheet is positioned over the PCB, and the tactile switch is disposed within an opening of the elastic spacer sheet. A rigid backer plate is positioned over the elastic spacer sheet, and a plastic film is positioned on the rigid backer plate. A related method for forming a control panel for an appliance is also provided.

16 Claims, 7 Drawing Sheets

CONTROL PANEL FOR AN APPLIANCE

FIELD OF THE INVENTION

The present subject matter relates generally to control panels for appliances and methods for producing the same.

BACKGROUND OF THE INVENTION

Appliances generally include a control panel having a plurality of buttons, keys, or other input devices. Utilizing the control panel, an appliance user can input control commands to the appliance and operate the appliance. Certain control panels include tactile switches. Tactile switches have benefits. For example, tactile switches can provide feedback to a user of the appliance during actuation.

Tactile switches can also have drawbacks. For example, constructing a control panel with tactile switches can be problematic due to thickness constraints on control panel components. In particular, tactile switches generally operate when actuated a certain distance. Sizing control panel components to provide consistent actuation while also providing a pleasant cosmetic appearance can be difficult.

Accordingly, a control panel with features for providing uniform tactile switch actuation would be useful. In addition, a method for producing control panels for an appliance that provides uniform tactile switch actuation for each control panel would be useful.

BRIEF DESCRIPTION OF THE INVENTION

The present subject matter provides a control panel for an appliance. The control panel includes a tactile switch positioned on a PCB. An elastic spacer sheet is positioned over the PCB, and the tactile switch is disposed within an opening of the elastic spacer sheet. A rigid backer plate is positioned over the elastic spacer sheet, and a plastic film is positioned on the rigid backer plate. A related method for forming a control panel for an appliance is also provided. Additional aspects and advantages of the invention will be set forth in part in the following description, or may be apparent from the description, or may be learned through practice of the invention.

In a first exemplary embodiment, a control panel for an appliance is provided. The control panel includes a printed circuit board (PCB) having a first surface. A tactile switch is positioned on the PCB at the first surface of the PCB. An elastic spacer sheet is positioned over the PCB at the first surface of the PCB. The elastic spacer sheet defines an opening. The tactile switch is disposed within the opening of the elastic spacer sheet. A rigid backer plate is positioned over the elastic spacer sheet such that the rigid backer plate is positioned opposite the PCB about the elastic spacer sheet. A plastic film is positioned on the rigid backer plate such that the plastic film is positioned opposite the elastic spacer sheet about the rigid backer plate.

In a second exemplary embodiment, a control panel for an appliance is provided. The control panel includes a carrier and a printed circuit board (PCB) having a first surface and a second surface. The second surface is positioned opposite the first surface on the PCB. The PCB is mounted to the carrier at the second surface of the PCB. A tactile switch is positioned on the PCB at the first surface of the PCB. An elastic spacer sheet is positioned on the PCB at the first surface of the PCB. The elastic spacer sheet defines an opening. The tactile switch is disposed within the opening of the elastic spacer sheet. A metal backer plate is positioned on the elastic spacer sheet such that the metal backer plate is positioned opposite the PCB about the elastic spacer sheet. A plastic film positioned on the metal backer plate such that the plastic film is positioned opposite the elastic spacer sheet about the metal backer plate.

In a third exemplary embodiment, a control panel for an appliance is provided. The control panel includes a carrier and a printed circuit board (PCB) having a first surface and a second surface. The second surface is positioned opposite the first surface on the PCB. The PCB is mounted to the carrier at the second surface of the PCB. A tactile switch is positioned on the PCB at the first surface of the PCB. An elastic spacer sheet is positioned on the PCB at the first surface of the PCB. The elastic spacer sheet defines an opening. The tactile switch is disposed within the opening of the elastic spacer sheet. A plastic film adhered to the elastic spacer sheet such that the plastic film is positioned opposite the PCB about the elastic spacer sheet. The plastic film has a thickness of no less than twenty thousandths of an inch.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
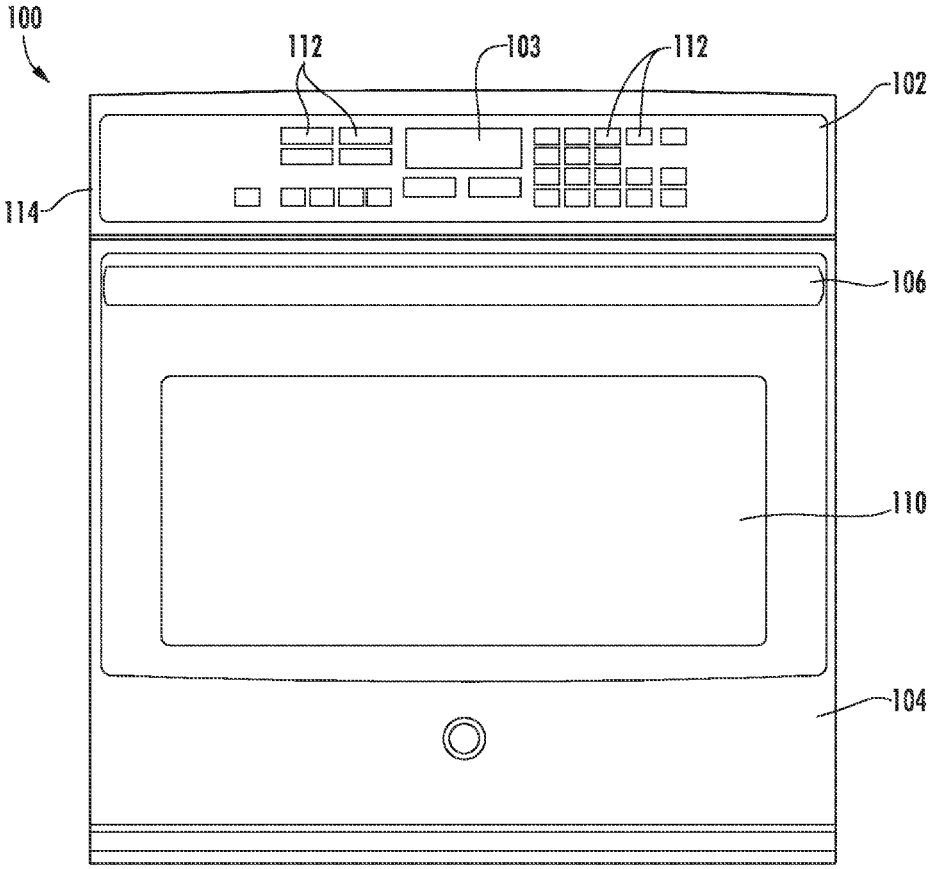
FIG. 1 provides a front elevation view of an oven appliance according to an exemplary embodiment of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In the present disclosure, when a layer, sheet or plate is being described as "on" or "over" another layer, substrate, sheet or plate, it is to be understood that the layers may either be directly contacting each other or have another layer or feature between the layers. Thus, these terms are simply describing the relative position of the layers to each other and do not necessarily mean "on top of" since the relative position above or below depends upon the orientation of the device to the viewer.

FIG. 1 provides a front elevation view of an oven appliance 100 according to an exemplary embodiment of the present subject matter. As may be seen in FIG. 1, oven appliance 100 includes a door 104 with a handle 106 that provides for opening and closing access to a cooking chamber within oven appliance 100. A user of the oven appliance 100 can place a variety of different items to be cooked in the cooking chamber, and oven appliance 100 includes heating elements (not shown) for heating the cooking chamber. For example, oven appliance 100 may include a broil or top heating element and a bake or bottom heating element to provide heat for cooking, as will be understood by those skilled in the art. The top and bottom heating elements can be gas burners, electric resistance heating elements, microwave elements, or combinations thereof. A window 110 on door 104 allows the user to view the cooking chamber during the cooking process.

Figure 2:
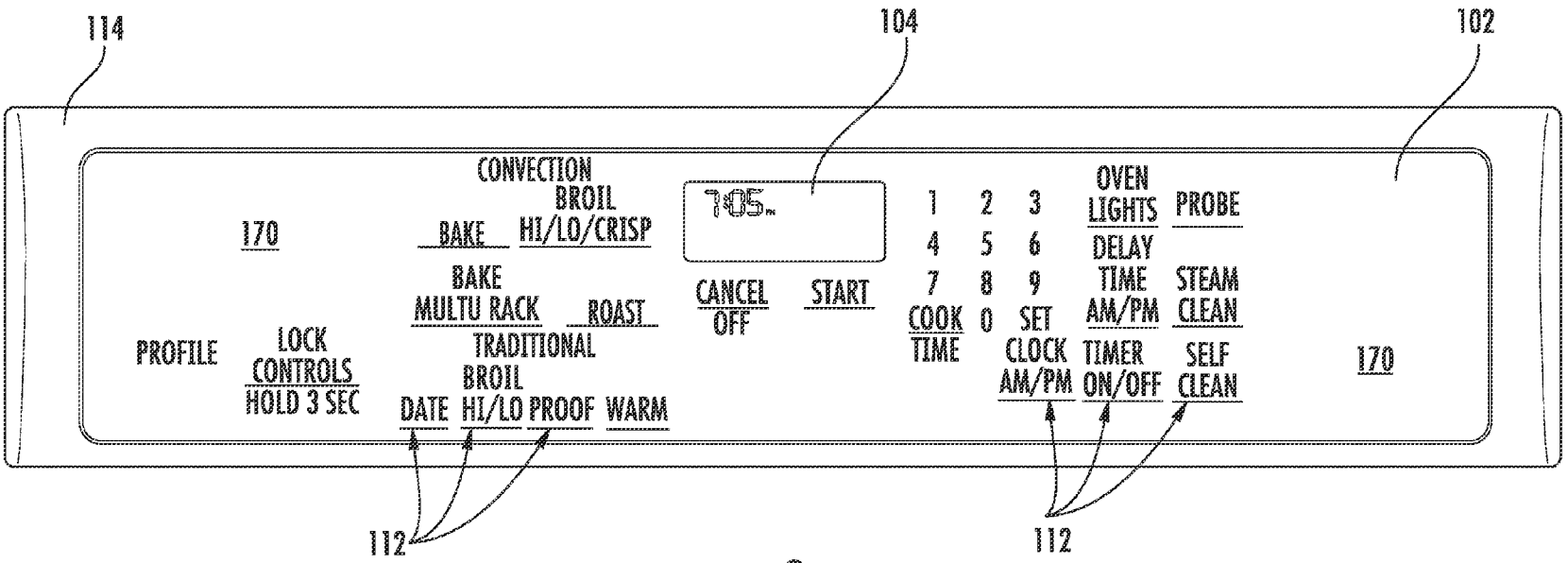
FIG. 2 provides a front elevation view of a control panel of the exemplary oven appliance of FIG. 1.

Oven appliance 100 also includes a user interface or control panel 102 having a display 103 and a variety of controls 112. Control panel 102 may be positioned on a top panel 114 of oven appliance 100. FIG. 2 provides a front elevation view of control panel 102 of oven appliance 100. Control panel 102 and controls 112 allow a user of oven appliance 100 to select various options for the operation of oven appliance 100 including e.g., temperature, time, and/or various cooking and cleaning cycles.

Operation of oven appliance 100 can be regulated by a controller (not shown) that is operatively coupled or in communication with control panel 102, the top and bottom heating elements and other components of oven appliance 100. As an example, in response to user manipulation of control panel 102, the controller can operate the top and bottom heating elements. The controller can also receive measurements from a temperature sensor (not shown) within the cooking chamber and provide a temperature indication to the user with display 103. Input/output ("I/O") signals are routed between the controller and various operational components of appliance 100, such as the top and bottom heating elements, controls 112, display 103, sensor(s), alarms, and/or other components as may be provided. In one embodiment, control panel 102 may represent a general purpose I/O ("GPIO") device or functional block.

As will be understood by those skilled in the art, oven appliance 100 is provided by way of example only. Thus, although shown as a single wall oven appliance in the exemplary embodiment of FIG. 1, the present subject matter can also be used with other oven appliances. For example, the present subject matter may be used with double wall oven appliances, oven range appliances, etc. In addition, the present subject matter may be used in any other suitable appliance, in alternative exemplary embodiments. For example, the present subject matter may be used with refrigerator appliances, dishwasher appliances, etc.

Figure 3:
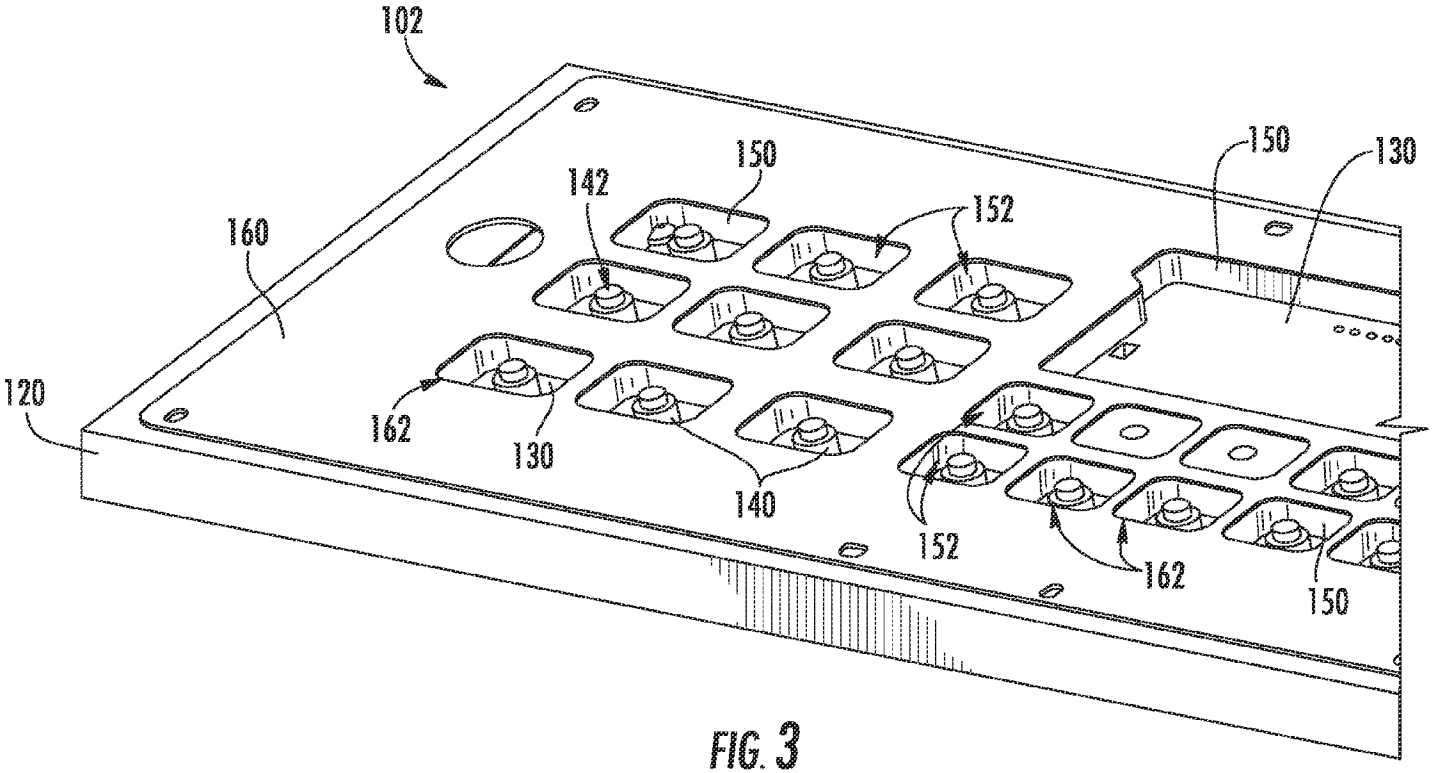
FIG. 3 provides a partial perspective view of certain components of the control panel of FIG. 2.
Figure 4:
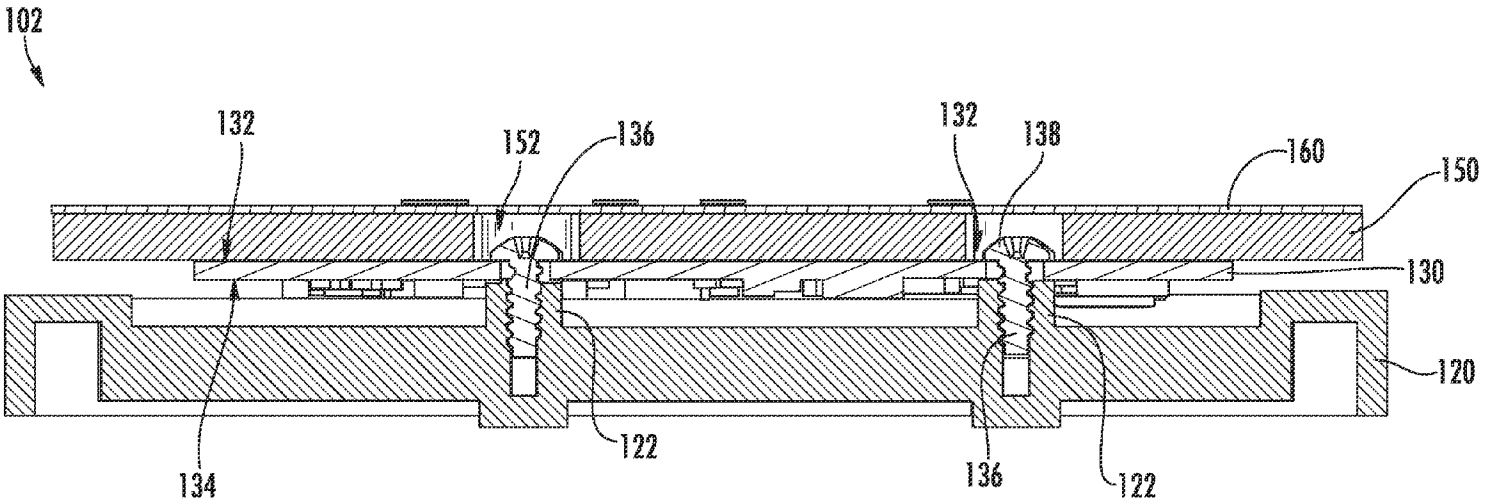
FIG. 4 provides a section view of the control panel of FIG. 3.
Figure 5:
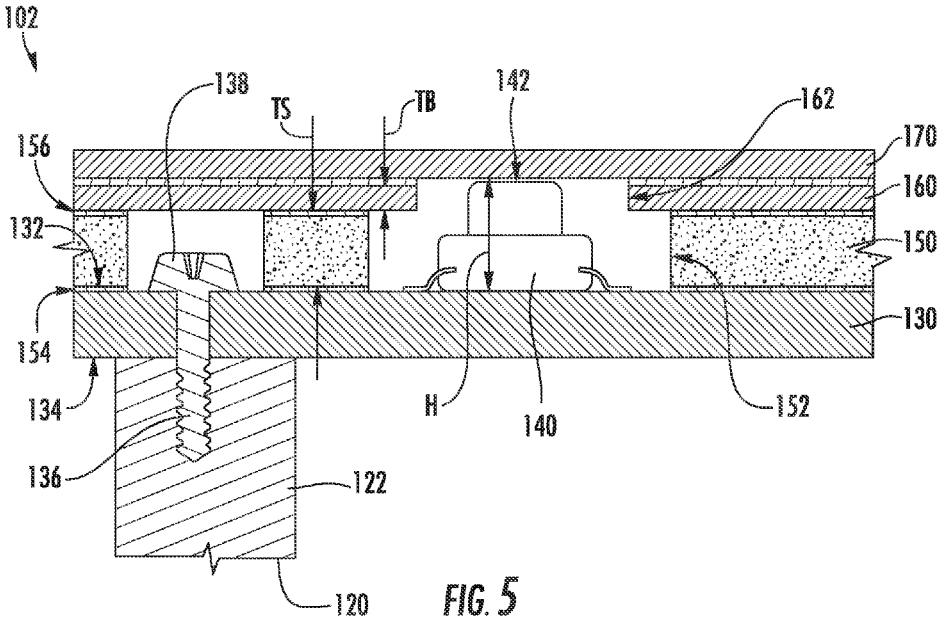
FIG. 5 provides a partial section view of the control panel of FIG. 2.

FIG. 3 provides a partial perspective view of certain components of control panel 102. FIG. 4 provides a section view of control panel 102, and FIG. 5 provides another section view of control panel 102. Control panel 102 and construction of control panel 102 are discussed in greater detail below in the context of FIGS. 3, 4 and 5.

As may be seen in FIG. 3, control panel 102 includes a carrier 120 and a printed circuit board (PCB) 130. Carrier 120 may be constructed of or with any suitable material, such as molded plastic. PCB 130 is mounted or connected to carrier 120. Carrier 120 supports PCB 130, e.g., in order to limit deformation of PCB 130. Thus, carrier 120 may be configured to reinforce or support PCB 130. As an example, fasteners 136 may extend through PCB 130 into a leg, boss or rib 122 of carrier 120, as shown in FIG. 4, to mount PCB 130 to carrier 120.

PCB 130 has a first surface 132 and a second surface 134. First surface 132 and second surface 134 of PCB 130 are positioned opposite each other about PCB 130. Thus, first surface 132 and second surface 134 of PCB 130 are spaced apart from each other. PCB 130 may be positioned on and/or mounted to carrier 120 at second surface 134 of PCB 130, and a plurality of tactile switches 140 is positioned on PCB 130 at first surface 132 of PCB 130. Thus, tactile switches 140 and carrier 120 may be positioned opposite each other about PCB 130. A respective one or more of tactile switches 140 may be associated with each one of controls 112 on control panel 102. Heads 138 of fasteners 136 may also be positioned on or at first surface 132 of PCB 130, e.g., such that fasteners 136 extend from first surface 132 of PCB 130 through PCB 130 into carrier 120.

Control panel 102 also includes an elastic spacer sheet 150. Elastic spacer sheet 150 is positioned over PCB 130 at first surface 132 of PCB, 130. Thus, elastic spacer sheet 150 and carrier 120 may be positioned opposite each other about PCB 130. Elastic spacer sheet 150 defines a plurality of openings 152. Tactile switches 140 are disposed within openings 152 of elastic spacer sheet 150. In particular, each tactile switch of tactile switches 140 may be disposed within a respective opening of openings 152 of elastic spacer sheet 150.

Control panel 102 also includes a rigid backer plate 160. It should be understood that rigid backer plate 160 is rigid relative to elastic spacer sheet 150 but may be less rigid compared to other components of control panel 102. Rigid backer plate 160 is positioned over or on elastic spacer sheet 150. Rigid backer plate 160 may be positioned opposite PCB 130 about elastic spacer sheet 150. Thus, e.g., rigid backer plate 160 may be mounted to elastic spacer sheet 150, and elastic spacer sheet 150 may extend between and/or connect PCB 130 and rigid backer plate 160. Rigid backer plate 160 may also define a plurality of openings 162, and each opening of openings 162 of rigid backer plate 160 may be positioned over and aligned with a respective opening of openings 152 of elastic spacer sheet 150. Thus, tactile switches 140 may be accessible through elastic spacer sheet 150 and rigid backer plate 160 via openings 152 of elastic spacer sheet 150 and openings 162 of rigid backer plate 160.

Elastic spacer sheet 150 and rigid backer plate 160 may be constructed of or with any suitable materials. For example, elastic spacer sheet 150 may be constructed of a with a first material, such as a skived plastic foam or elastomer, and rigid backer plate 160 may be constructed of or with a second material, such as a steel, aluminum or a rigid plastic. The first material may have a Young's modulus that is significantly less than a Young's modulus of the second material. As used herein, the term "significantly less" means no less than an order of magnitude less than when used in the context of Young's moduli. As a particular example, elastic spacer sheet 150 may be a double-sided foam tape or panel, and the double-sided foam tape or panel may be adhered to and extend between PCB 130 and rigid backer plate 160. Thus, an adhesive may be provided at a first interface 154 between PCB 130 and elastic spacer sheet 150 and/or at a second interface 156 between elastic spacer sheet 150 and rigid backer plate 160. As another particular example, elastic spacer sheet 150 may be an elastomer sheet, and rigid backer plate 160 may be a metal plate that is adhered or mechanically fastened to elastic spacer sheet 150.

Control panel 102 further includes a plastic film 170. Plastic film 170 is positioned on or over rigid backer plate 160, e.g., on a smooth or flat surface of rigid backer plate 160. For example, plastic film 170 may be adhered to rigid backer plate 160. Plastic film 170 may be positioned opposite elastic spacer sheet 150 about rigid backer plate 160. Plastic film 170 may also extend or be positioned over openings 152 of elastic spacer sheet 150 and/or openings 162 of rigid backer plate 160. Plastic film 170 may be elastically deformable such that a user may press on plastic film 170 above tactile switches 140 at openings 152 of elastic spacer sheet 150 in order to actuate tactile switches 140. Graphics may be provided on plastic film 170, as shown in FIG. 2, in order to provide an indication of the input or command associated with each tactile switch of tactile switches 140.

Elastic spacer sheet 150 and rigid backer plate 160 of control panel 102 may assist with constructing control panel 102 such that tactile switches 140 are consistently actuatable by a user. In particular, rigid backer plate 160 may assist with providing a flat, uniform surface to which plastic film 170 may be adhered or mounted, e.g., such that bubbling or wave forming on plastic film 170 is limited or prevented. In addition, elastic spacer sheet 150 may uniformly position rigid backer plate 160 and/or plastic film 170 over tactile switches 140, e.g., such that tactile switches 140 actuate uniformly or evenly across control panel 102.

As shown in FIG. 5, rigid backer plate 160 defines a thickness TB, e.g., at opening 162 of rigid backer plate 160, and elastic spacer sheet 150 defines a thickness TS, e.g., at opening 152 of elastic spacer sheet 150. Tactile switch 140 also extends away from PCB 130 to a distal end 142 of tactile switch 140 by a height H, e.g., such that the height H of tactile switch 140 is defined between first surface 132 of PCB 130 and distal end 142 of tactile switch 140. A sum of the thickness TB of rigid backer plate 160 and the thickness TS of elastic spacer sheet 150 may be about equal to the height H of tactile switch 140. As used herein, the term "about" means within one-half millimeter of the stated value when used in the context of thicknesses and/or heights.

Control panel 102 may be constructed easily and/or quickly relative to other control panel designs, e.g., due to the tolerances provided by components of control panel 102. An exemplary method for constructing control panel 102 is discussed in greater detail below.

To construct control panel 102, PCB 130 with tactile switches 140 positioned on first surface 132 of PCB 130 may be provided. Openings 152 of elastic spacer sheet 150 may also be cut into elastic spacer sheet 150. For example, as discussed above, elastic spacer sheet 150 may be a double-sided foam tape or panel, and the double-sided foam tape or panel may be die-cut to form openings 152 in the double-sided foam tape or panel. As another example, elastomer spacer sheet 150 may be molded from an elastomer with openings 152 formed during molding.

Elastic spacer sheet 150 may then be positioned on or over PCB 130 with tactile switches 140 disposed within openings 152 of elastomer spacer sheet 150. In particular, elastic spacer sheet 150 may be adhered directly to PCB 130. Rigid backer plate 160 may then be positioned over elastic spacer sheet 150. In particular, rigid backer plate 160 may be adhered directly to elastomer spacer sheet 150, e.g., such that elastomer spacer sheet 150 extends between PCB 130 and rigid backer plate 160. Plastic film 170 may be positioned on rigid backer plate 160 before or after positioning rigid backer plate 160 over elastomer spacer sheet 150.

In such a manner, control panel 102 may be constructed with a short, simple tolerance loop that is robust to process variation in component parts of control panel 102. Thus, control panel 102 may have more uniform actuation force and button feel across controls 112 on control panel 102. In particular, control panel 102 may be constructed as a near vertical stack assembly relative to other control panel designs. In addition, tooling cost for constructing control panel 102 may be lower relative to other control panel designs, e.g., when elastomer spacer sheet 150 is die cut to provide openings 152 or size elastomer spacer sheet 150 and/or when openings 162 of rigid backer plate 160 are formed with a laser cutter.

Figure 6:
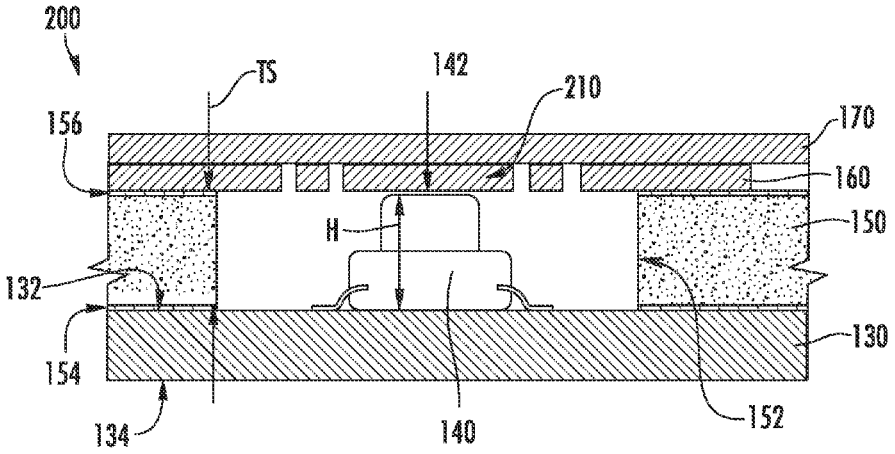
FIG. 6 provides a section view of a control panel according to another exemplary embodiment of the present subject matter.
Figure 7:
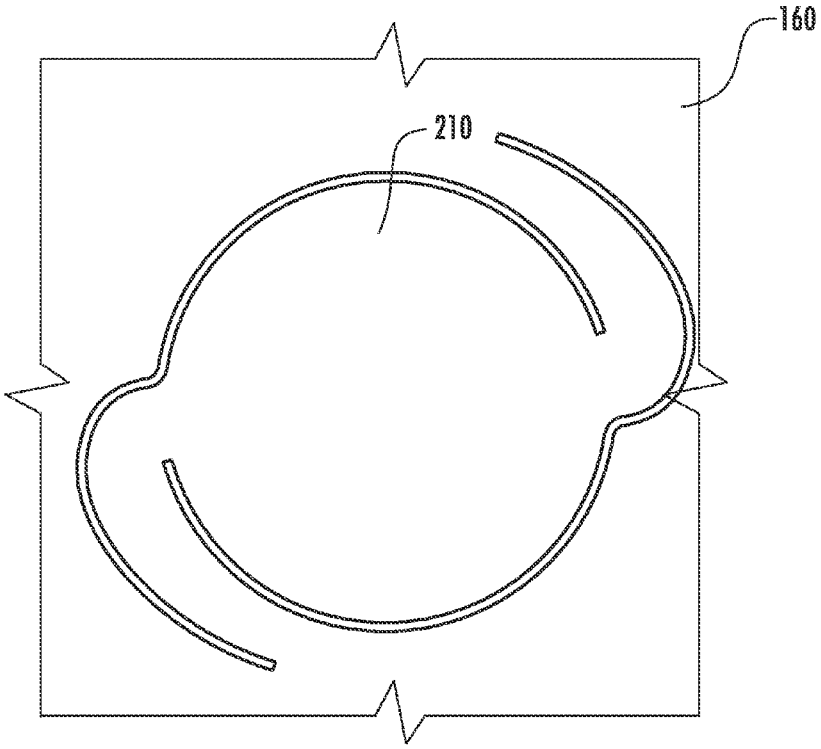
FIG. 7 provides a top plan view of a button of the exemplary control panel of FIG. 6.

FIG. 6 provides a section view of a control panel 200 according to another exemplary embodiment of the present subject matter. FIG. 7 provides a top plan view of a button 210 of control panel 200. As may be seen in FIGS. 6 and 7, control panel 200 includes the similar components to control panel 102 (FIG. 3) and may be constructed in a similar manner. However, rather than openings 162 as shown in FIG. 4, rigid backer plate 160 includes a cantilevered arm or button 210 over tactile switch 140 and opening 152 of elastic spacer sheet 150. Button 210 may provide desirable feedback to a user of control panel 200 during actuation of tactile switch 140. In control panel 200, the thickness TS of elastic spacer sheet 150 may be about equal to the height H of tactile switch 140 due to button 210. As shown in FIG. 7, rigid backer plate 160 may be cut or otherwise formed to provide button 210 on rigid backer plate 160.

In alternative exemplary embodiments, control panel 200 may be constructed or assembled without rigid backer plate 160. Thus, control panel 200 need not include rigid backer plate 160 in such alternative exemplary embodiments. A thickness of elastic spacer sheet 150 may be relatively large to compensate for removing rigid backer plate 160. As an example, the thickness of elastic spacer sheet 150 may be no less than twenty thousandths of an inch (0.020"), e.g., in order to limit or prevent a wavy appearance for elastic spacer sheet 150, and the thickness TS of elastic spacer sheet 150 may be about equal to the height H of tactile switch 140 due to button 210. In particular, the thickness TS of elastic spacer sheet 150 may be no more than ten thousandths of an inch (0.010") greater than the height H of tactile switch 140 or no more than five thousandths of an inch (0.005") greater than the height H of tactile switch 140, e.g., such that elastic spacer sheet 150 does not require significant elastic deformation to actuate button 210.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A control panel for an appliance, comprising:

a printed circuit board (PCB) having a first surface;

a tactile switch positioned on the PCB at the first surface of the PCB;

an elastic spacer sheet positioned over the PCB at the first surface of the PCB, the elastic spacer sheet defining an opening, the tactile switch disposed within the opening of the elastic spacer sheet;

a rigid backer plate positioned over the elastic spacer sheet such that the rigid backer plate is positioned opposite the PCB about the elastic spacer sheet, the rigid backer plate defining an opening, the opening of the rigid backer plate aligned with the opening of the elastic spacer sheet; and a plastic film positioned on the rigid backer plate such that the plastic film is positioned opposite the elastic spacer sheet about the rigid backer plate, wherein the rigid backer plate defines a thickness at the opening of the rigid backer plate and the elastic spacer sheet defines a thickness at the opening of the elastic spacer sheet, the tactile switch also extending away from the PCB by a height, a sum of the thickness of the rigid backer plate and the thickness of the elastic spacer sheet being about equal to the height of the tactile switch.

2. The control panel of claim 1, wherein the elastic spacer sheet comprises double-sided foam tape.

3. The control panel of claim 2, wherein the double-sided foam tape is adhered to and extends between the PCB and the rigid backer plate.

4. The control panel of claim 1, wherein the elastic spacer sheet comprises an elastomer.

5. The control panel of claim 1, wherein the rigid backer plate defines a cantilevered arm positioned over the tactile switch at the opening of the elastic spacer sheet.

6. The control panel of claim 1, wherein the elastic spacer sheet defines a thickness at the opening of the elastic spacer sheet, the tactile switch also extending away from the PCB by a height, the thickness of the elastic spacer sheet being about equal to the height of the tactile switch.

7. The control panel of claim 1, wherein the plastic film is positioned over the opening of the elastic spacer sheet and the tactile switch.

8. The control panel of claim 1, wherein the rigid backer plate comprises a metal plate.

9. A control panel for an appliance, comprising:

a carrier;

a printed circuit board (PCB) having a first surface and a second surface, the second surface positioned opposite the first surface on the PCB, the PCB mounted to the carrier at the second surface of the PCB;

a tactile switch positioned on the PCB at the first surface of the PCB;

an elastic spacer sheet positioned on the PCB at the first surface of the PCB, the elastic spacer sheet defining an opening, the tactile switch disposed within the opening of the elastic spacer sheet;

a metal backer plate positioned on the elastic spacer sheet such that the metal backer plate is positioned opposite the PCB about the elastic spacer sheet, the metal backer plate defining an opening, the opening of the metal backer plate aligned with the opening of the elastic spacer sheet; and a plastic film positioned on the metal backer plate such that the plastic film is positioned opposite the elastic spacer sheet about the metal backer plate, wherein the metal backer plate defines a thickness at the opening of the metal backer plate and the elastic spacer sheet defines a thickness at the opening of the elastic spacer sheet, the tactile switch also extending away from the PCB by a height, a sum of the thickness of the metal backer plate and the thickness of the elastic spacer sheet being about equal to the height of the tactile switch.

10. The control panel of claim 9, wherein the elastic spacer sheet comprises double-sided foam tape.

11. The control panel of claim 10, wherein the double-sided foam tape is adhered to and extends between the PCB and the metal backer plate.

12. The control panel of claim 9, wherein the elastic spacer sheet comprises an elastomer.

13. The control panel of claim 9, wherein the metal backer plate defines a cantilevered arm positioned over the tactile switch at the opening of the elastic spacer sheet.

14. The control panel of claim 9, wherein the elastic spacer sheet defines a thickness at the opening of the elastic spacer sheet, the tactile switch also extending away from the PCB by a height, the thickness of the elastic spacer sheet being about equal to the height of the tactile switch.

15. The control panel of claim 9, wherein the plastic film is positioned over the opening of the elastic spacer sheet and the tactile switch.

16. A control panel for an appliance, comprising:

a carrier;

a printed circuit board (PCB) having a first surface and a second surface, the second surface positioned opposite the first surface on the PCB, the PCB mounted to the carrier at the second surface of the PCB;

a tactile switch positioned on the PCB at the first surface of the PCB;

an elastic spacer sheet positioned on the PCB at the first surface of the PCB, the elastic spacer sheet defining an opening, the tactile switch disposed within the opening of the elastic spacer sheet, the elastic spacer sheet having a thickness of no less than twenty thousandths of an inch; and a plastic film adhered to the elastic spacer sheet such that the plastic film is positioned opposite the PCB about the elastic spacer sheet, wherein the elastic spacer sheet defines a thickness at the opening of the elastic spacer sheet, the tactile switch also extending away from the PCB by a height, the thickness of the elastic spacer sheet being about equal to the height of the tactile switch.

* * * * *